United States Patent [19]

Andre et al.

[11] Patent Number: 4,578,928

[45] Date of Patent: Apr. 1, 1986

[54] HIGH SPEED EVACUATION CHAMBER PACKAGING MACHINE AND METHOD

[75] Inventors: L. George Andre, Cincinnati, Ohio; Lawrence D. Boody, Oak Ridge, Tenn.; Charles M. Heard, Mt. Prospect, Ill.; Harrison A. Ailey, Jr., Knoxville, Tenn.

[73] Assignees: Acraloc Corporation, Oak Ridge, Tenn.; Tipper Tie, Inc., Union, N.J.

[21] Appl. No.: 511,323

[22] Filed: Jul. 6, 1983

[51] Int. Cl.[4] ..... B65B 31/00

[52] U.S. Cl. ..... 53/512; 53/91; 53/373

[58] Field of Search ..... 53/91, 372, 373, 434, 53/512; 138/478, 483, 802

[56] References Cited

U.S. PATENT DOCUMENTS

| | | | |
|---|---|---|---|
| 2,275,978 | 3/1942 | Mingle | 198/478 X |
| 3,246,595 | 4/1966 | Wharton et al. | 198/478 X |
| 3,269,080 | 8/1966 | Howe, Jr. | 53/512 X |
| 3,794,315 | 2/1974 | Kaneko et al. | 53/372 X |
| 3,795,085 | 3/1974 | Andre et al. | 53/512 |
| 3,958,391 | 5/1976 | Kujubu | 53/534 |
| 4,457,124 | 7/1984 | Hartmann | 53/512 |

FOREIGN PATENT DOCUMENTS

| | | | |
|---|---|---|---|
| 2247452 | 4/1974 | Fed. Rep. of Germany | 53/512 |
| 370233 | 8/1963 | Switzerland | 53/512 |
| 1436471 | 5/1976 | United Kingdom | 53/434 |

*Primary Examiner*—John Sipos
*Assistant Examiner*—Steven P. Weihrouch
*Attorney, Agent, or Firm*—Pitts and Brittian

[57] ABSTRACT

A high speed evacuation chamber packaging machine (10) and method is provided. The machine (10) includes a frame (12) which carries a plurality of stations (18). Each station (18) includes a platen (32) which faces upwardly and carries the bagged product during the evacuation operations. A hood (34) is associated with each platen and is selectively operable between an open position for loading and unloading the bag product and a closed position which defines an evacuation chamber (34) with the platen. Means are provided for selectively evacuating and reducing the vacuum level within the chamber (36) containing the bagged product and for selectively evacuating the bag itself to a preselected level which has a lower pressure than the pressure within the chamber. A device (84) for sealing and trimming the bag subsequent to the evacuation is also provided and carried along a path of travel similar to the travel of the bag position on a station platen.

6 Claims, 25 Drawing Figures

Fig. 5
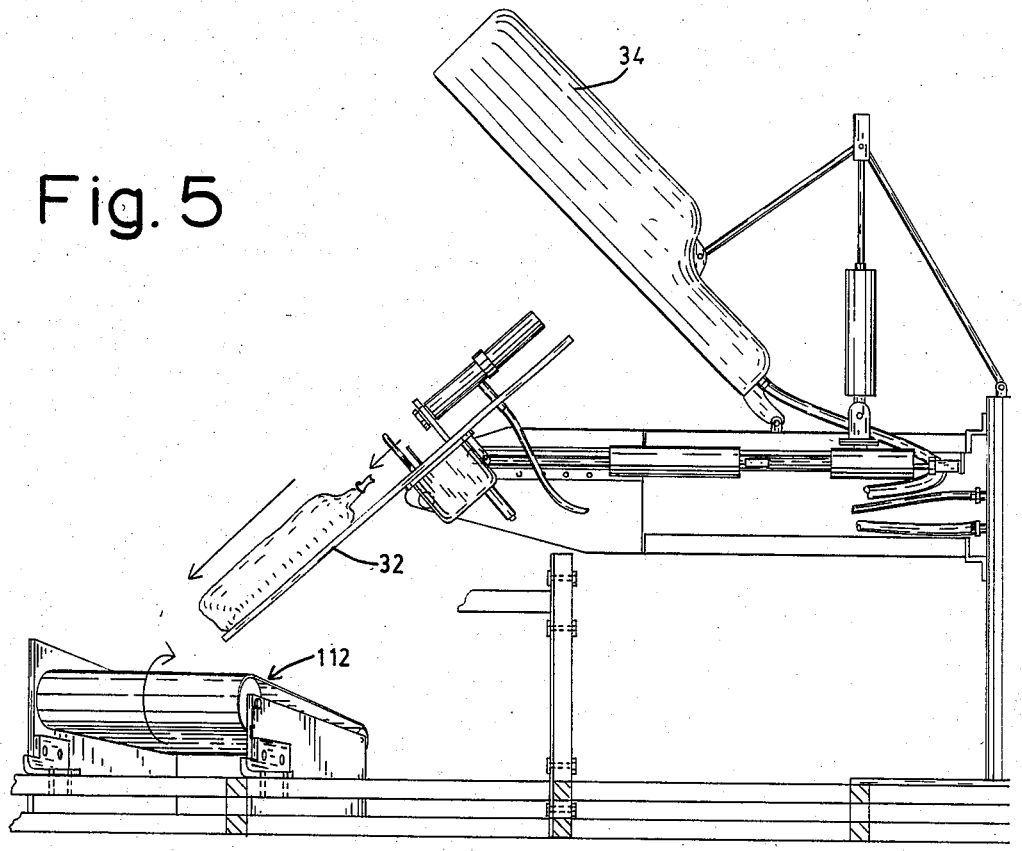
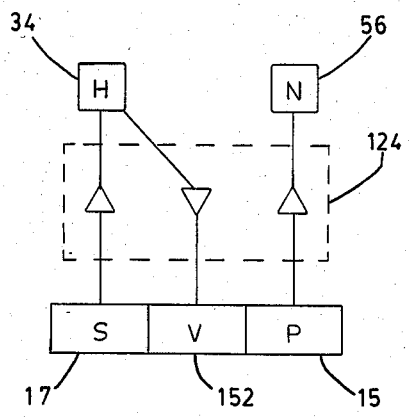
Fig.12

HIGH SPEED EVACUATION CHAMBER PACKAGING MACHINE AND METHOD

DESCRIPTION

1. Technical Field

This invention relates generally to packaging machines, and more particularly concerns a packaging machine designed to package and seal felxible receptacles or bags containing a product desired to be stored in a vacuum. The present machine accomplishes such vacuum packaging by generating a differential pressure inside and outside the bag to avoid the production of air pockets within the vacuum packed bag.

2. Background Art

Evacuation chamber packaging machines have heretofore been known. Such machines generally include means for evacuating the volume within the bag in which a product is to be stored. Subsequent to the creation of a negative pressure within the bag proximate the product, the bag is clipped and trimmed for further processing. One such prior art device is illustrated in U.S. Pat. No. 3,795,085 which is incorporated by reference herein. This device includes a rotatable assembly having a circular table portion and a plurality of radially oriented evacuation nozzles and clamps for each nozzle for sealing the bag neck on the nozzle during the evacuation operations. Other known prior art devices generally relating to the field of the present invention are described in the following U.S. Pat. Nos. 4,189,897; 4,049,020; 3,648,430 and the prior art documents referenced in such U.S. patents.

The machine of the present invention is principally designed to control the pressure differential inside and outside of the bag during the evacuation operation such that air pockets normally generated within the bag are minimized. In this connection, a negative pressure is generated exterior the bag and then interior the bag prior to the sealing or clipping operation.

Accordingly, it is an objective of the present invention to provide a high speed evacuation chamber packaging machine which produces a bagged product having minimal air pockets such that the shelf life of the bagged product is increased. Another object of the present invention is to provide such a machine which can be economically manufactured and readily cleaned. Further, the machine of the present invention is designed so that it can be operated in an automatic mode which creates a differential pressure within and without the bag or it can be operated in a mode such that a negative pressure is generated within the bag only. Thus, the machine can be used to package various size products, and even products which cannot be contained within the hood.

DISCLOSURE OF THE INVENTION

Other objects and advantages can be accomplished by the present invention which provides a machine and method for the high speed evacuation and sealing of a bagged product. The machine includes a frame and at least one station carried by the frame. Each station includes a platen facing upwardly for carrying bagged product during the evacuation operations. A hood associated with the platen is selectively operable between an open position for loading and unloading the bagged product and a closed position defining an evacuation chamber with said platen. Means are provided for selectively evacuating and reducing the vacuum level within the chamber containing the bagged product in the chamber volume exterior the bagged product. Means are also provided for selectively evacuating the bag to a preselected level. The bag is then sealed thereby establishing the vacuum packaging of the product.

BRIEF DESCRIPTION OF THE DRAWINGS

The above-mentioned features of the present invention and other objects and advantages will be more clearly understood from consideration of the following description together with the accompanying drawings in which:

FIG. 5 illustrates the machine operation during unloading.

FIG. 12 is a diagrammatic illustration of a vacuum control valve illustrating the various vacuum and vent connections made with the hood and nozzle.

BEST MODE FOR CARRYING OUT THE INVENTION

Figure 1:
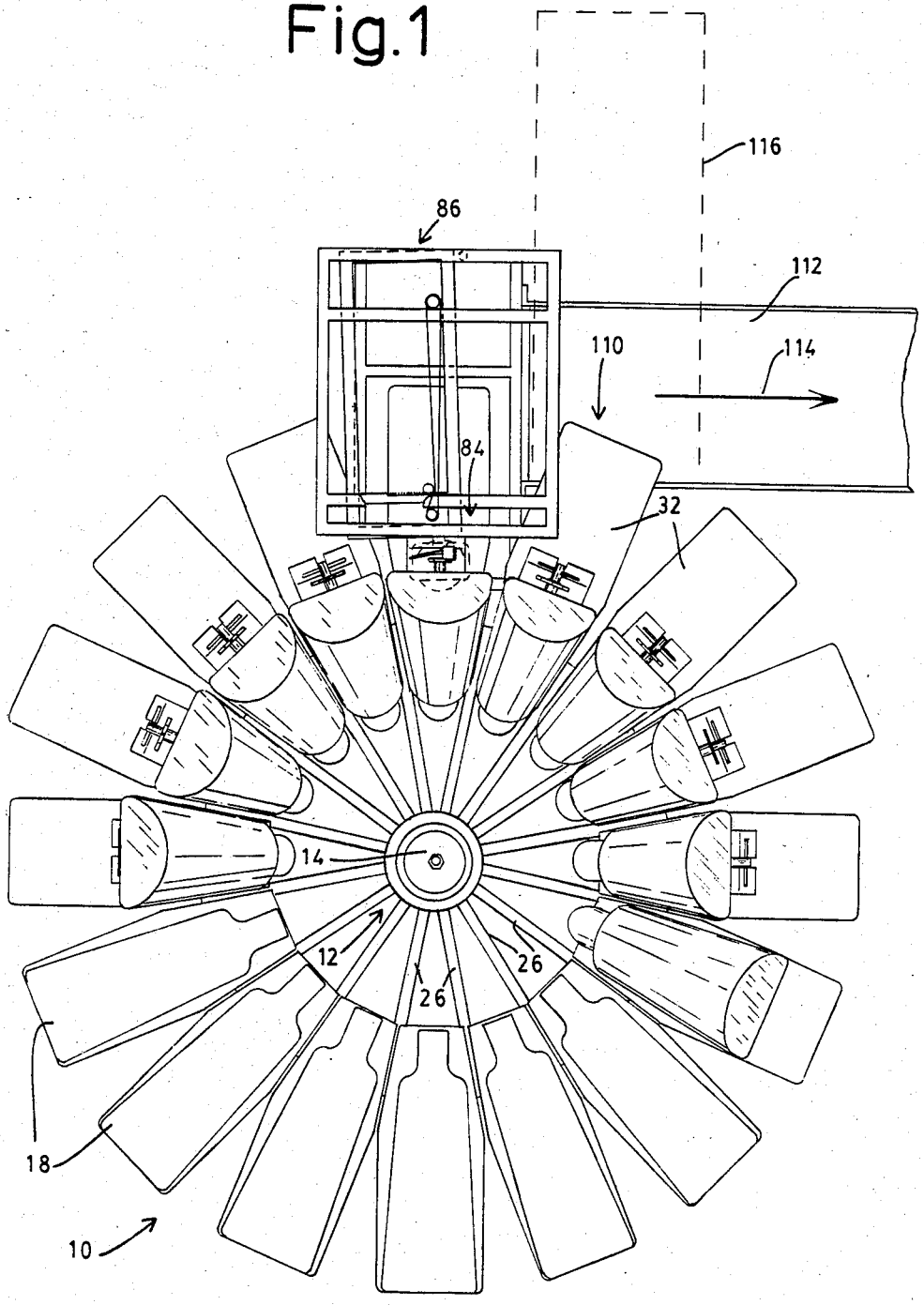
FIG. 1 illustrates a high speed evacuation chamber packaging machine incorporating various features of the present invention. This figure illustrates a plan view of the machine, and it should be understood that the number of stations and the geometric configuration of the machine itself can vary.

Referring now to the drawings, a high speed evacuation chamber packaging machine incorporating various features of the present invention is generally indicated at 10 in FIG. 1. This machine is designed for packaging and sealing flexible receptacles or usually heat shrinkable polymeric bags containing a product (such as meat) desired to be packaged in a vacuum. The machine 10 is designed for being used as an in-line machine which is compact and readily integrated into existing packaging procedures without costly modifications which might otherwise be required to expedite product flow. While the machine is designed for in-line operation, it should be recognized that its use is not limited to such operation and that the principles and features of the invention could be readily incorporated in various machine embodiments. For example, while the machine 10 illustrated in FIG. 1 includes a plurality of rotating stations to be defined in greater detail hereinafter, such stations could be arranged in other configurations, such as being carried by a conveyer or the like.

The machine 10 includes a frame 12 which is mounted on a suitable supporting surface such as the floor of a building. This frame 12 includes a stationary hub 14 as illustrated in FIG. 1 and in FIG. 8. This hub 14 defines a lower pedestal 21 which includes an annular shoulder 23. The lower portion of the pedestal 21 is mounted or positioned on the floor as is illustrated in the cross-sectional view in FIG. 8. This hub is substantially hollow and incorporates conduits 20 and 22 which serve to provide fluid communication between the pneumatic air supply 122 and the primary vacuum source 15, respectively, as illustrated diagrammatically in FIG. 8. The upper end portion 25 of the conduit 20 connects the pneumatic air supply 122 through a conventional union (not shown) to each of the stations 18 as will be described in greater detail hereinafter. Thus, the air supplied through the conduit 20 feeds the stations for accomplishing the various pneumatic operations.

The primary vacuum source 15 and the secondary vacuum source 17 are of conventional design and will incorporate a suitable motor which will generate the desired negative pressure for accomplishing the evacuation of the chamber and of the bag to a desired level. Moreover, a conventional control system (not shown) will normally be provided to allow adjustment of the vacuum level of the primary vacuum source 15 and the secondary vacuum source 17. For example, in a preferred embodiment, the secondary vacuum source which is applied to the hood can be adjusted between approximately 12 inches Hg and 26 inches Hg. The primary vacuum source 15, will normally be adjusted to a level greater than the level of the secondary vacuum source during the machine operation.

Figure 8:
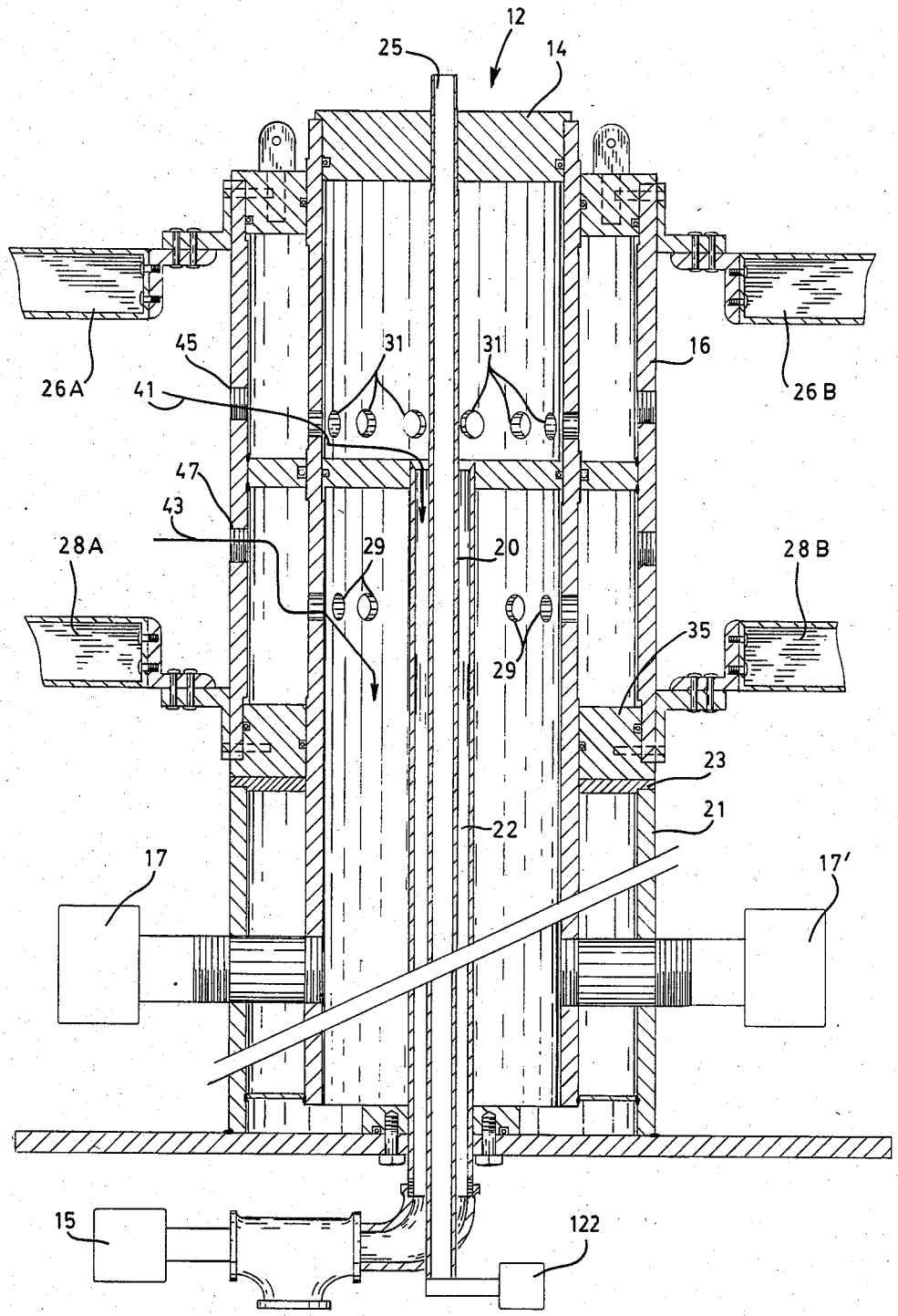
FIG. 8 illustrates a cross-sectional view of the hub and portions of the wheel.

As illustrated in FIG. 8, an alternate or secondary vacuum source 17' is provided as a back-up. Each of the secondary vacuum sources are connected in fluid communication with the toroidial shaped chamber 27 in the hub. The secondary vacuum source is connected through the annularly spaced ports 29 and the vacuum valve 124 with the hood to be described in greater detail hereinafter. Similarly, the primary vacuum source is connected through conduit 22, hub chamber 33 and ports 31 to the nozzle and vacuum valve.

Figure 6:
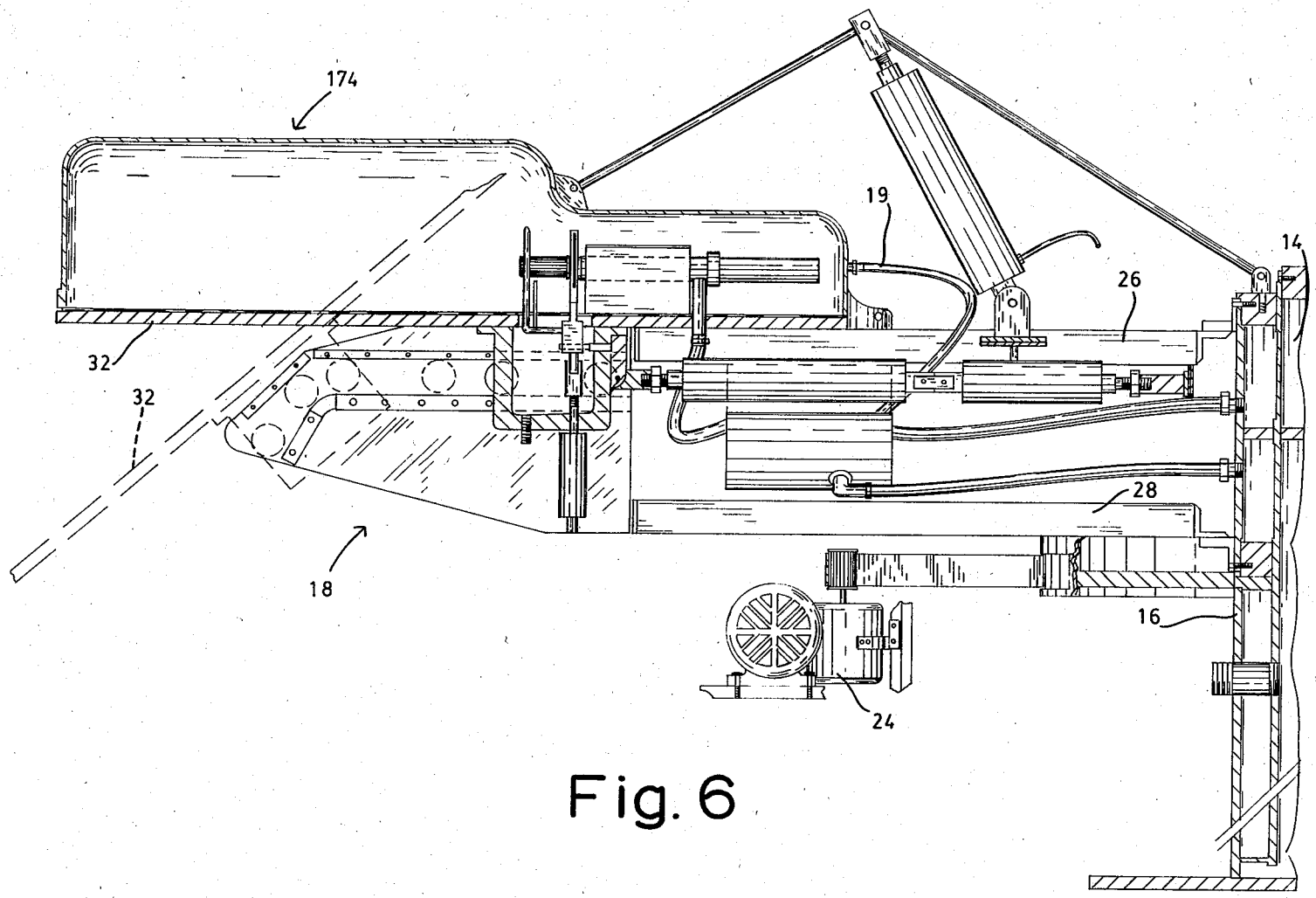
FIG. 6 illustrates a side elevation view of a station together with the means for rotatably driving the wheel member which carries the various annularly spaced stations.

This hub 14 carries wheel member 16 which is rotatably driven about the hub by conventional drive means such as the motor 24 illustrated in FIG. 6. It will be noted that this motor 24 is connected to the wheel member 16 by a conventional drive method such as a timing belt, gears, etc. A belt drive is shown in FIG. 6. Wheel member 16 is driven at a preselected speed which is coordinated with the loadings, off loading and other machine operations. The hub is seated on a bronze bearing, in the preferred embodiment, generally indicated at 35. This bearing is supported by the hub shoulder 23 and allows the wheel member 16 to rotate with respect to the hub and hub pedestal 21.

During rotation, the primary vacuum source is connected to the nozzle of each station through the vacuum valve 124, to be described in greater detail hereinafter, as is indicated by the air flow arrow 41. It will be seen that this arrow 41 passes through the wheel member port 45, the ports 31 and connects the nozzle with the primary vacuum source 15. Similarly, the hood is connected to the secondary vacuum source 17 (and optionally 17') through the wheel member port 47 and the hub ports 29 as is indicated by the flow arrow 43.

Each of the stations 18 is supported by radially extending spokes or arms. Portions of the upper arms 26 and the lower arms 28 are illustrated in FIG. 8. FIG. 6 further exemplifies the arms 26 and 28, respectively, in supporting a typical station 18.

Figure 2A:
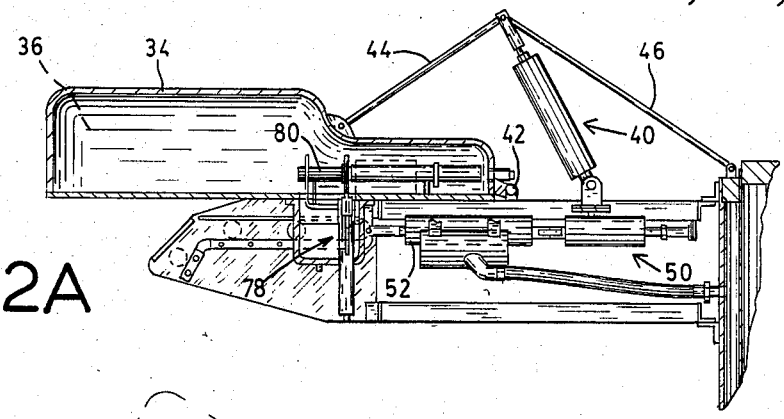
FIGS. 2A–C illustrate a machine station at various positions during the machine operation.
Figure 2B:
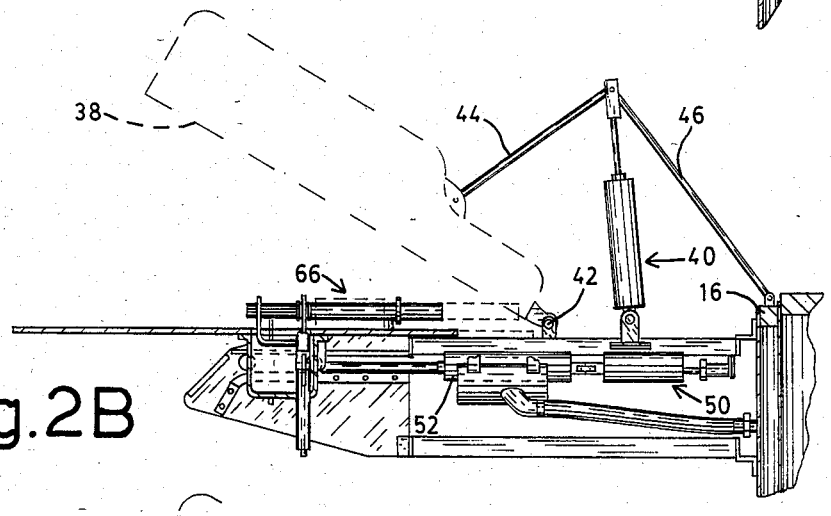
Figure 2C:
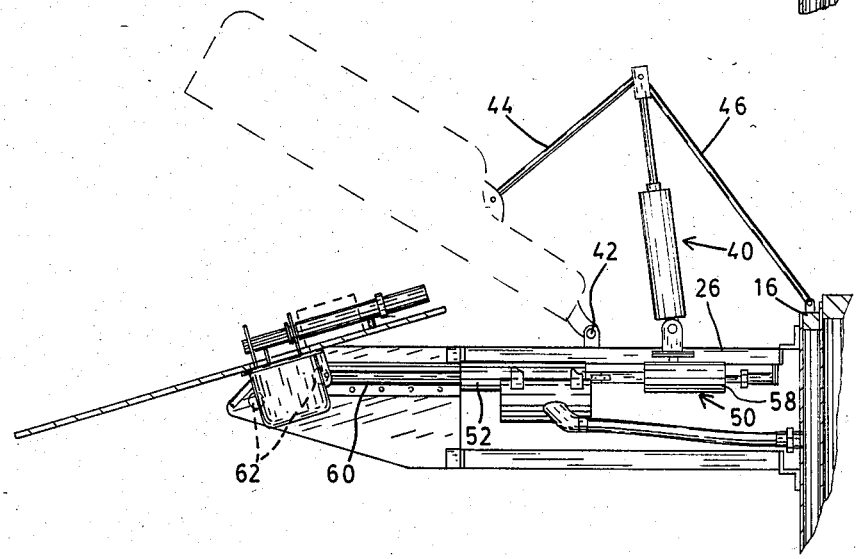
Figure 7:
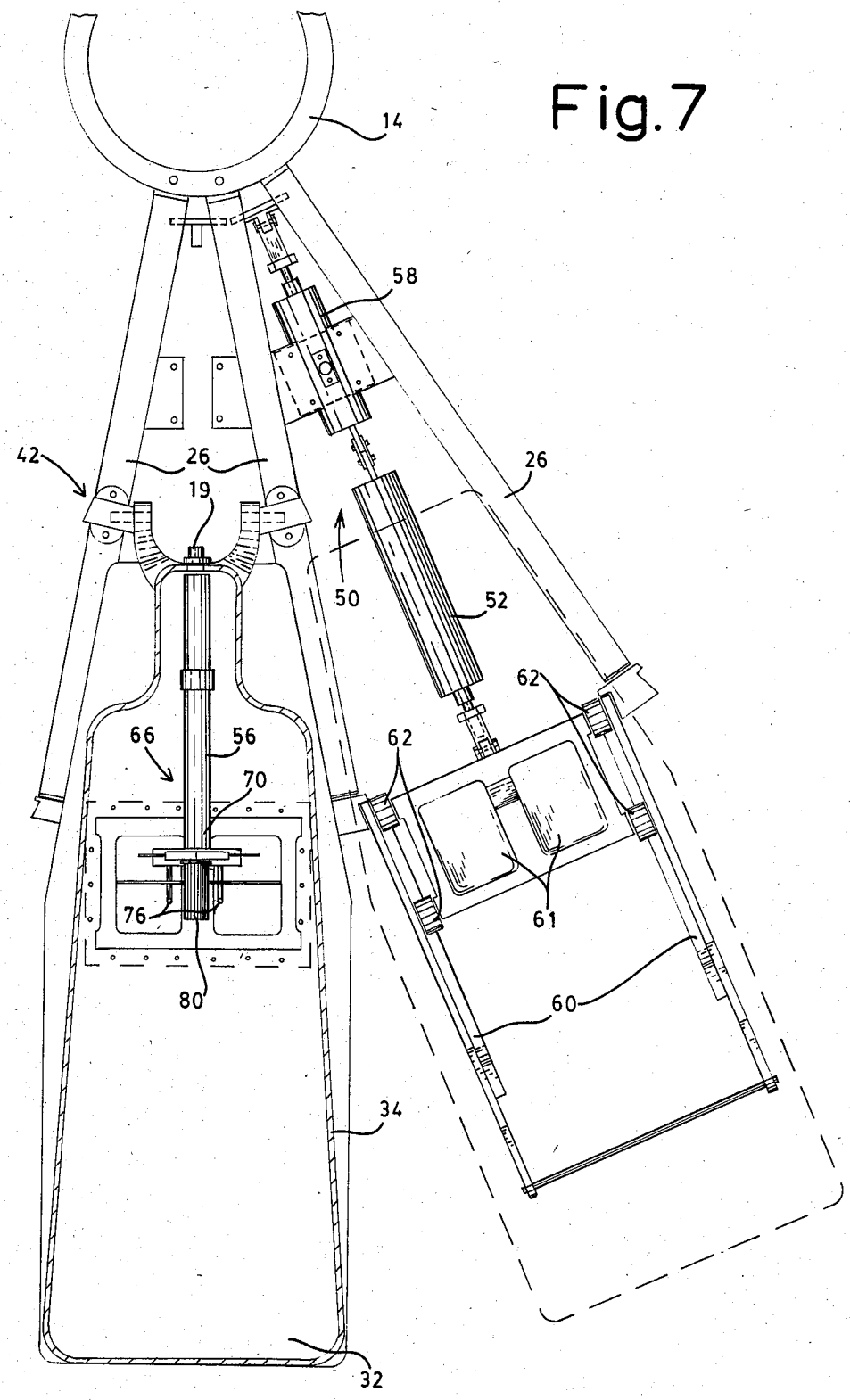
FIG. 7 illustrates a plan view of adjacent stations and the wells within which portions of the clamps and the clamp drives are carried by the platen to the station. More specifically, the left hand station shows the platen and nozzle arrangement, and the other station illustrates features below the platen surface.

Each of the stations 18 includes a substantially planer platen 32 which serves to carry the bagged product during the evacuation and sealing operations. In this connection, the platen defines a product zone which faces upwardly and supports the bagged product subsequent to its being loaded on such platen as by an operator. A hood 34 is operatively associated with each of the platens 32 and can be moved from an open positon as illustrated in FIG. 2B for loading and unloading the bagged product to a closed position as illustrated in FIG. 2A. Upon closing the hood 34 to its sealed position, a chamber 36 is defined between the interior surface of the hood and the upwardly facing platen. This chamber 36 is hermetically sealed as by providing a rubber seal or gasket along the lower edge 38 of the hood (see FIG. 2B). The hood 34 is moved from its opened to its closed position by the pneumatic cylinder and associated piston generally indicated at 40 in FIG. 2. This piston and cylinder are of conventional design and serve to pivot the hood about the pivot point 42 by operation on the arms 44 and 46, respectively, as illustrated in FIGS. 2A–C. The hood pivot point constructed on the arm 26 is shown in greater detail in FIG. 7. The secondary vacuum source 17 is selectively connected to the chamber 36 defined by closing the hood through a vacuum hose or conduit 19 (see FIG. 3C).

Means are provided at 50 for extending and retracting the platen 32 to facilitate loading and unloading the bagged product. More specifically, this means 50 includes a first pneumatic cylinder and piston 52 which is carried by the arm 26 (see FIGS. 2 and 7). Upon activation of this cylinder, the platen extends from the position illustrated in FIG. 2A to the position illustrated in 2B. Thus, activation of the cylinder 52 serves to drive the operatively associated piston arm forward which in turn slides the platen forward to the position as illustrated in FIG. 2B to facilitate loading the bagged product onto the platen when the hood is in its raised position.

In order to facilitate unloading the bagged product from the platen, means 58 (see FIGS. 2 and 7), which comprises a pneumatic cylinder and associated piston, serves to move the platen 32 to a sloped position as shown in FIG. 2C. In this regard, the station arms 26 and 28 carry a pair of guides 60 mounted on each side of the station. These guides operatively receive associated guide rollers or rods 62 which follow the path defined by the guides 60 upon activation of the sloping cylinder 58. Thus, when the cylinder 58 is activated with piston of cylinder 52 in the extended position, the platen and its frame which carry the guide rollers are moved to the position indicated in FIG. 2C.

Figure 3A:
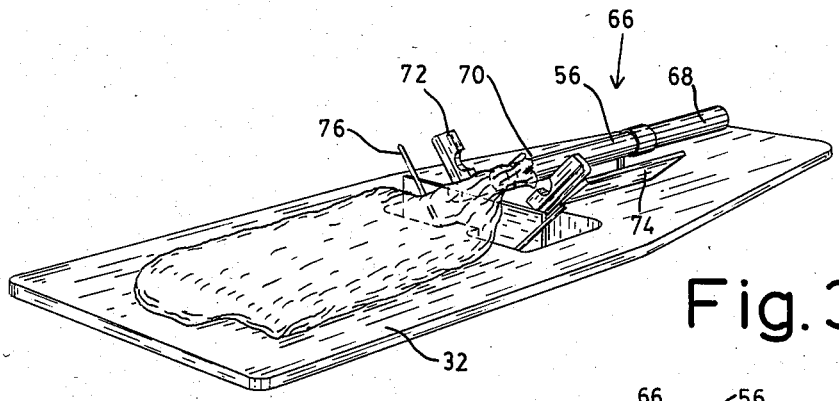
FIGS. 3A–C further depict a machine station and particularly the motion associated with the clamps which seal the bag about the nozzle during the evacuation operation.

A nozzle assembly generally indicated at 66 serves to evacuate the interior portion of the bag. This nozzle assembly 66 is more clearly illustrated in FIGS. 7 and 3A–C and includes a nozzle 56 mounted at a spaced location above the upper surface of the platen 32. The rearward end portion 68 of the nozzle is connected in fluid communication with a primary vacuum source which serves to evacuate the contents of the bag as illustrated in FIG. 3A. A forward end portion of the nozzle indicated at 70 serves to receive the neck portion of the bag which is gathered about this forward end portion of the nozzle 56 during preparation of the bagged product for the evacuation and clipping operation.

Figure 3B:
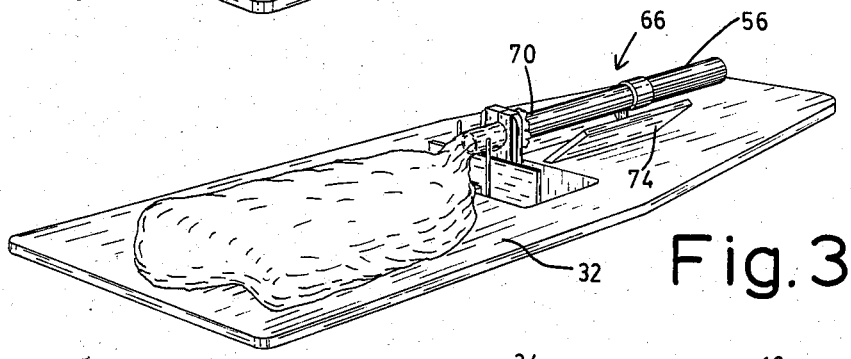
Figure 3C:
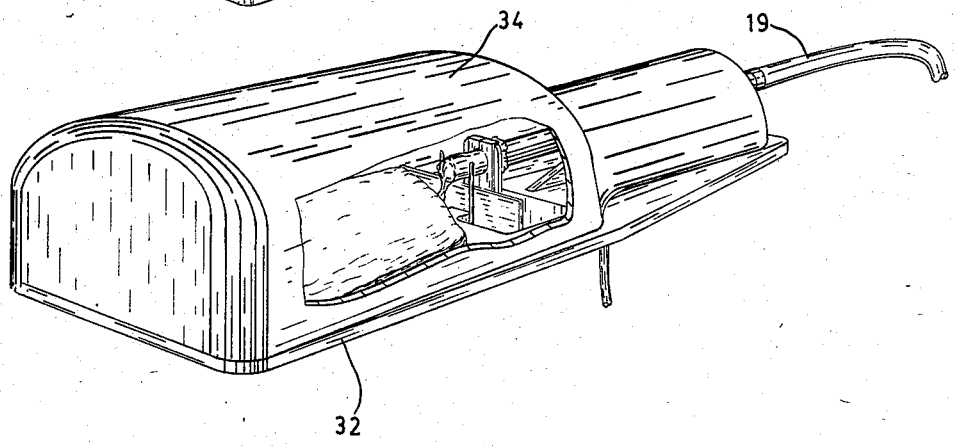

In this connection, cooperating clamps 72 are provided, each of which include an indented section, as is illustrated in FIGS. 3A–C, which gathers and seals the bag about the forward end 70 of the nozzle 56. The forward end 70 of the nozzle is proivded with an annular groove which received the registering grooves or indented sections of the pivotally mounted clamps 72. Thus, when the clamps are in the closed position as illustrated digrammatically in FIGS. 3B and 3C, the neck portion of the bag is hermetically sealed with the forward end portion of the nozzle such that the bag can be evacuated to a desired level.

The clamps 72 are pneumatically operated from their open position illustrated in FIG. 3A to their closed position as illustrated in FIG. 3B. Portions of the clamps and the conventional pneumatic drives for the clamps are mounted in the wells 61 of the platen shown in FIG. 7. A sloped plate 74 is mounted proximate the forward end portion 70 of the nozzle 56 and supports a switch S9 which is manually actuated by an operator to initiate pneumatic closure of the clamps and movement of the gathering rods 76 from their opened position illustrated in FIG. 3A to their closed position illustrated in 3B. These gathering rods 76 gather the neck portion of the bag and are pneumatically operated by means 78 carried in the wells 61 of the platen 32 (see FIGS. 2A and 7) which simultaneously close the gathering rods and the clamps.

A pneumatically actuated probe 80 (see FIGS. 2A and 7) is slideably received within the nozzle 56. This probe serves to position or stand-off the product contained in the bag at a location remote from the clamps 72 and the gathering rods 76, and is provided with a plurality of annularly spaced grooves which serve to define paths for the travel of air drawn from the bag during the evacuating operation. Thus, upon closure of the clamps to hermetically seal the neck of the bag with the nozzle 56, the desired vacuum is applied through the end portion 68 of the nozzle. This vacuum draws air from the bag and through the annularly spaced grooves in the probe which serve to prevent the neck of the bag from forming a seal with a nozzle end probe during evacuation.

Figure 4A:
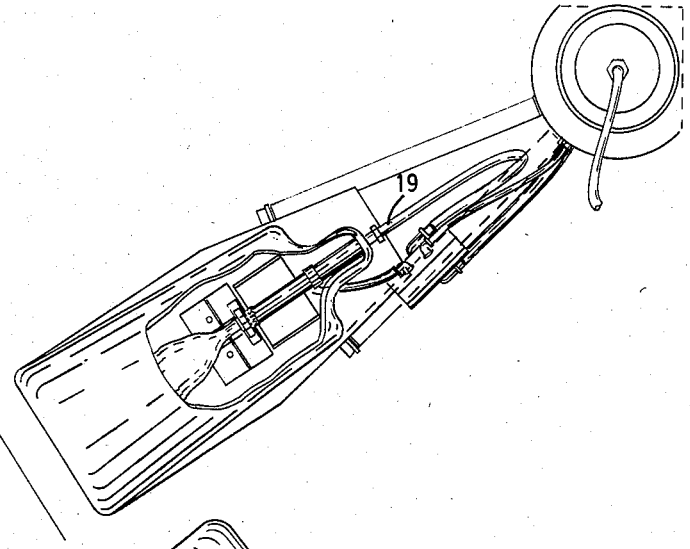
FIG. 4A illustrates a plan view of a single station together with the motion of its travel.
Figure 4B:
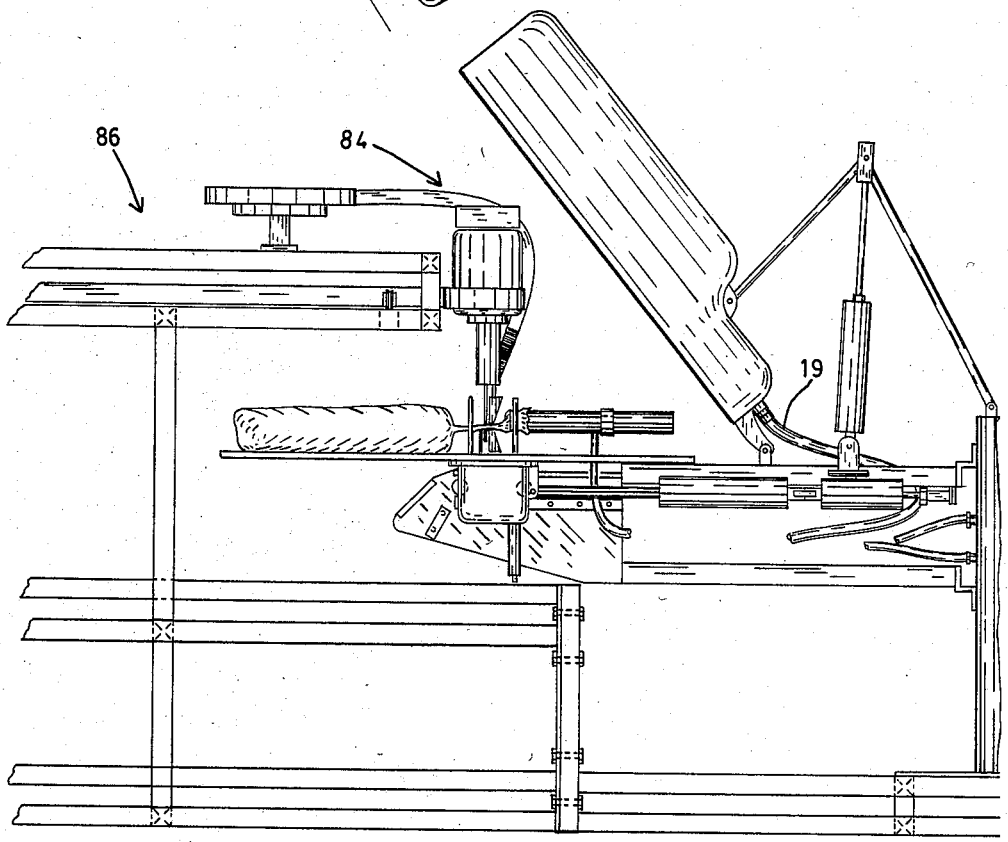
FIG. 4B diagrammatically illustrates a side elevation view of the machine during the sealing and clipping operation.

After the bag has been evacuated to a desired level, the bag is sealed and trimmed to secure the product at the desired vacuum level and prepare it for the off loading operation. The bag can be sealed by a number of conventional devices or methods; for example, it can be heat sealed, tied, clipped, etc. In the illustrated embodiment, the sealing is accomplished by a clipping and trimming device generally indicated at 84 and is shown in FIG. 4B. This device is of conventional design and examples of suitable devices are illustrated by U.S. Pat. Nos. 3,583,056, 3,576,088, and 3,266,138.

Figure 10:
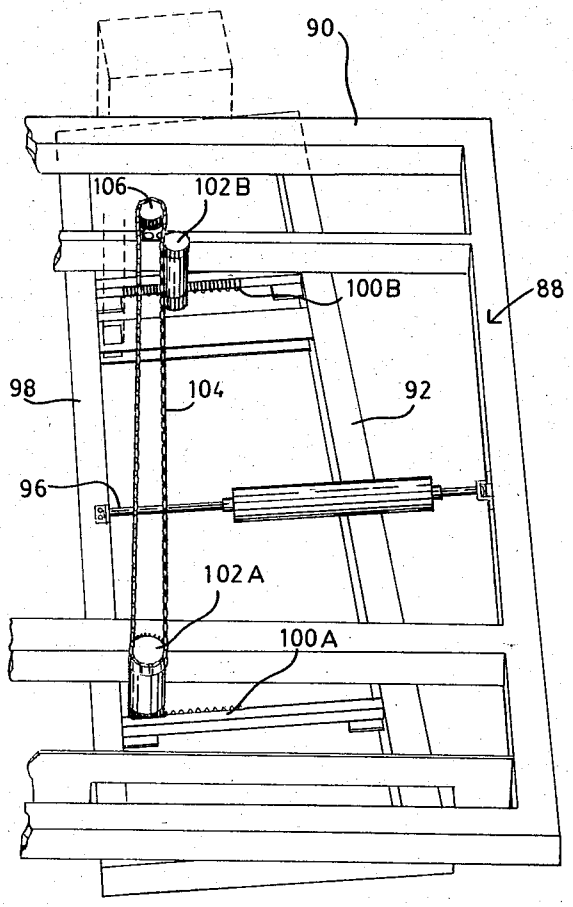
FIGS. 9 and 10 illustrate a means for carrying the clipping and trimming device along a path substantially identical to the path of travel of the bag neck as it is carried by a station.
Figure 9:
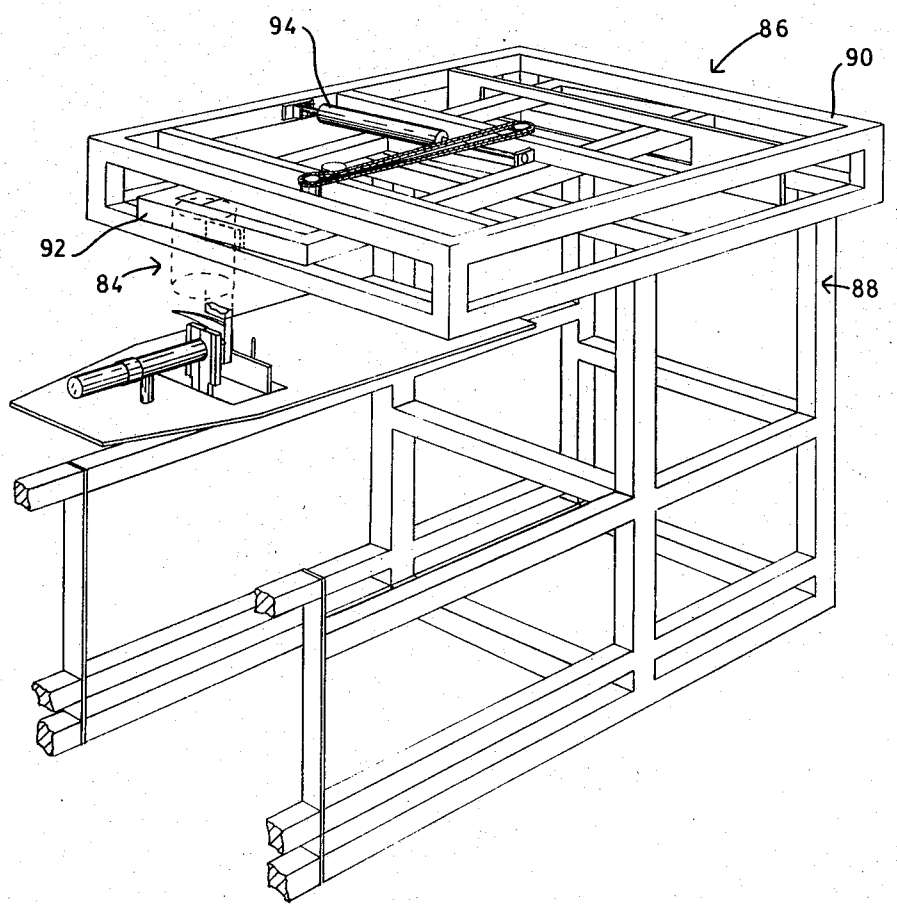

It has been found, however, that the speed of the machine operations and the effectiveness of the seal can be enhanced by moving the clipping and trimming device along the path of the neck portion of the bag while such clipping and trimming operation is accomplished. In this connection, means generally indicated at 86 serve to carry the clipping and trimming device 84 along an arc, in the preferred embodiment, which is substantially identical to the arc of travel of the neck of the bag which is carried by an operatively associated station, such that the clipping and trimming device and the neck of the bag travel along a substantially identical path while such operations are being performed. More specifically, a frame 88 (see FIGS. 9 and 10) serves to mount the means for carrying the clipping and trimming device 84 at a preselected location. This frame 88 includes an upper portion 90 which pivotally receives a carriage 92 upon which is mounted the clipping and trimming device 84. This carriage 92 is mounted such that the forward portion of the carriage to which is secured the clipping and trimming device 84, selectively travels along an arc substantially identical to the arc of travel of the neck portion of the bag. In this regard, the carriage 92 is pneumatically driven by the drive means 94 which in the illustrated embodiment comprises a pneumatic cylinder and associated piston which is secured at its outboard end portion 96 to a cross member 98 of the carriage 92 as illustrated in FIGS. 9 and 10. The precise path of travel of the forward end portion of the carriage 92 which carries the clipping and trimming device 84 is controlled by the cooperating racks 100A and 100B and operatively associated pinions 102A and 102B, respectively. It will be noted that these pinions are interconnected by the chain 104 which engages gear 106 mounted on the frame 88.

As shown in FIGS. 9 and 10, the chain 104 serves to fix the relative rotational speed of the pinions 102A and 102B, and, thus, does not serve as a drive chain per se, the drive means 94 being designed to act upon the carriage 92. Thus, to achieve arcuate travel of the carriage 92, pinion 102A is provided with gear surfaces defining a greater circumference (see FIG. 9) than that of the pinion 102B such that, the relative rotation of the pinions 102A and 102B being fixed, the pinion 102A allows greater motion to be imparted to the rack 100B. As will be recognized by those skilled in the art, with the range of motion of the rack 100B (see FIG. 9) being less than that of the rack 100A, and given the fixed position of the pinions 102A and 102B on the frame 88, an arcuate motion is imparted to the carriage 92 as it is driven by means 94. Thus, when the drive means or pneumatic cylinder 94 is activated, a piston pushes the carriage end portion to which is secured the device 82 in the direction of travel of the neck portion of the bag. The activation of the drive means 94 is coordinated with the speed of travel of the bag, and the path of the carriage means as defined by the carriage path control means comprising the illustrated racks, pinions, chain, and gear such that the clipping and trimming device travels along an arc substantially identical to the travel of the neck portion of the bag.

Subsequent to completion of the clipping and trimming operations, the drive means 94 is retracted to position the clipping and trimming device at a location for commencing the next clipping and trimming operation on a bag carried by the trailing adjacent station.

Subsequent to the clipping and trimming operation, the stations which travel in a clockwise direction as seen in FIG. 1, advance to the unloading or off-loading position, generally indicated at 110 in FIG. 1 and illustrated in greater detail in FIG. 5. At the unloading position, the platen is sloped as illustrated in FIG. 5, so that the bagged product slides along the upper surface of the platen onto a conveyer 112 of conventional design. As shown in FIG. 1, this conveyer carries the bagged product in the direction of the arrow 114 or as desired, the conveyer can be directed such that the bagged product is carried away from the machine 10 by an alternate conveyer position as illustrated at 116. It will, of course, be recognized that the conveyer is optional and that an operator standing proximate the location indicated at the 110 can unload the bagged product manually if necessary or desired. Subsequent to the unloading operation, a platen 32 is retracted to the position illustrated in FIG. 2B and the loading operation commences.

The hood is selectively connected with a secondary vacuum source 17 to evacuate the chamber 36 and cause the bag to balloon prior to the bag being evacuated to a lesser pressure by the primary vacuum source. It has been found that this process minimizes the development of air pockets within the bag next to the product. In the preferred embodiment, the sequencing of the vacuum application to the hood and nozzle is carefully controlled with a vacuum valve 124. The various modes of operation of this vacuum valve are shown diagrammatically in FIG. 12. As shown, the vacuum valve 124 selectively applies the vent 152 or the secondary vacuum 17 to hood 34. Also, as shown, the primary vacuum 15 is selectively applied to the nozzle.

Figure 13:
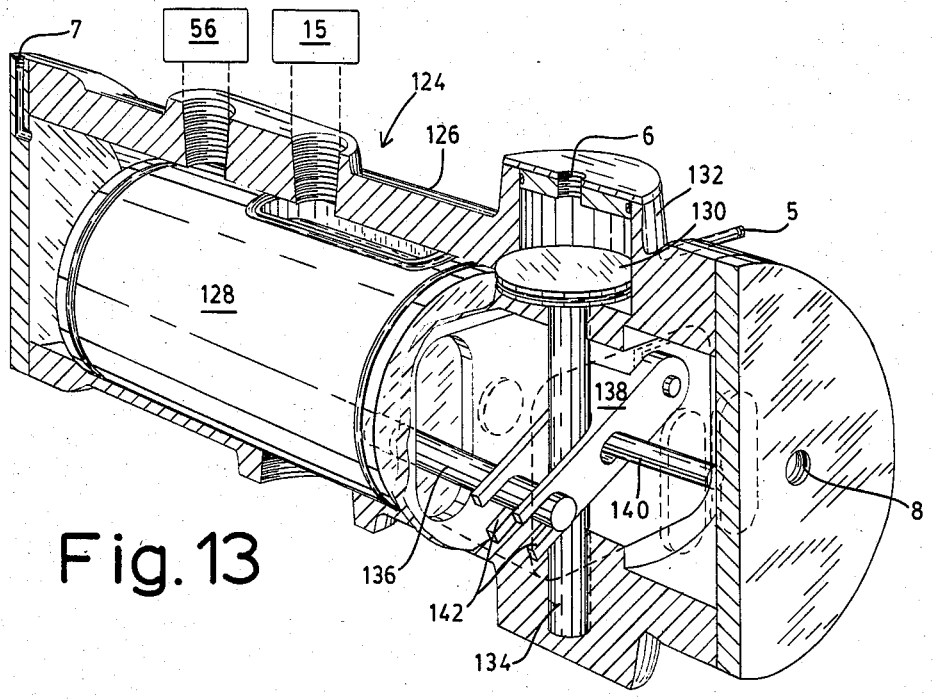
FIG. 13 illustrates a sectional perspective view of an exemplary vacuum control valve which is connected into the pneumatic system as shown in FIG. 14 for selectively applying the desired vacuum and/or vent to the hood and nozzle.

One suitable vacuum control valve or vacuum valve is illustrated generally at 124 in FIG. 13. This vacuum control valve includes a housing 126 having a plurality of ports therein. The housing receives a rotor 128 which can be advanced longitudinally within the housing by the injection of air or another suitable fluid through the port 7. In this connection, the longitudinal position of the rotor 128 is shifted toward the opposite end portion of the housing 126. The introduction of air into port 8 at the opposite end of the housing will shift the rotor toward the port 7. Thus, the opposite ends of the flattened rotor serve as the head portion of a piston for longitudinal movement of the rotor.

Rotation of the rotor for proper alignment or connection of the nozzle and hood with the vacuum source and vent is accomplished by the piston 130. More specifically, this piston 130 includes a substantially cylindrical head slideably received within the cylinder portion 132 of the housing 126. Upon the introduction of a fluid such as air through the port 6 this piston 130 is moved downwardly to the position illustrated in FIG. 13. As shown, the piston 134 is drivingly connected through the rotor arm 136 through a pivotally mounted fork 138 which is carried by the wall of the housing. The piston arm 134 and the fork 138 are joined by the rod 140 which is received within the illustrated slot defined in the fork 138. The forward most end portion of the rotor arm 136 is received within the registering slots 142 of the fork 138.

In order to shift the piston 130 to its upper most position, proximate the port 6, a fluid such as air is injected through the port 5 which opens into the area of the cylinder 132 below the piston head. Thus the introduction of a pressurized fluid such as air into such area of the cylinder will raise the piston with respect to its position as shown in FIG. 13 and thereby rotate the rotor 128 approximately 90 degrees.

Figure 15A:
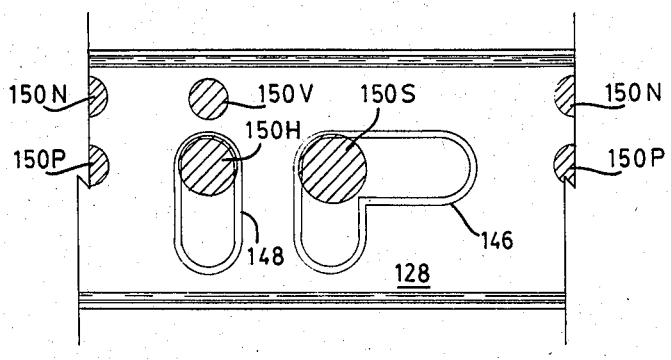
FIGS. 15A–D illustrate the various positions of the vacuum control valve depicted in FIGS. 13 and 14.

The various positions of the vacuum valve 124 for accomplishing the desired connections with hood and nozzle are illustrated in FIGS. 15A–15D. More specifically, the rotor 128 is flattened for illustrative purposes and the ports of the valve which are connected by the grooves in the rotor are illustrated by shaded lines. As shown in FIG. 15A, the rotor groove 146 is L-shaped in geometric configuration and the rotor groove 148 as illustrated in FIG. 15A is spaced annularly therefrom.

Upon injection of air through the ports 5 and 7, the alignment of the groves 146 and 148 of the rotor 128 with the ports in the housing is illustrated. Port 150V is connected in fluid communication with the vent 152 diagrammatically illustrated in FIG. 14. The port 150H is connected with the hood 134 through the conduit 19. The housing port 150S is connected in fluid communication with the secondary vacuum source 17 (see FIG. 14). The housing port 150N is connected with the nozzle 56. The housing port 150P is connected with the primary vacuum source 15 (see FIG. 14).

When air is injected through ports 5 and 7 of the valve 124, illustrated in FIG. 13, the valve is in an off positon since neither the hood nor the nozzle are connected by the grooves 148 and 146 of the rotor with a vacuum source or vent. This is the condition of the machine upon the sealing and clipping operation. It will be noted that since the nozzle is sealed and not vented in this condition, ambient atmosphere is prevented from entering the vacuum system.

Figure 15B:
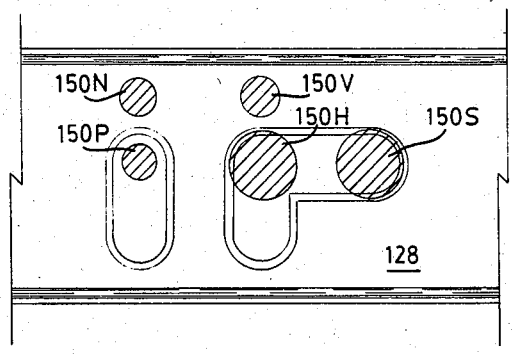

Upon introduction of a pneumatic pressure into the housing through port 6, the piston is driven downwardly as seen in FIG. 13 and the rotor is rotated such that the hood and nozzle port 150H and 150N, respectively, are positioned as illustrated in FIG. 15B. It should be noted that the rotor is in the longitudinal and axial position as illustrated in FIG. 13 inasmuch as pneumatic pressure is also introduced through the port 7. In this position, the hood is connected with the secondary vacuum source 17 and the nozzle is sealed or in an off position.

Figure 15C:
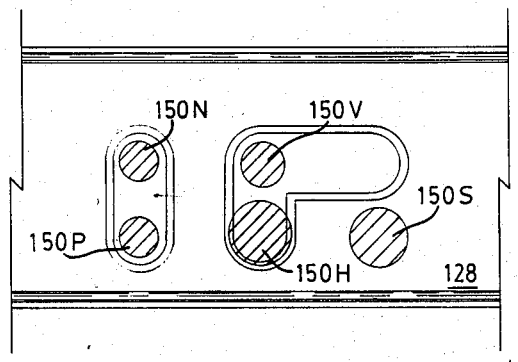

By introducing pneumatic pressure through the port 8 of the vacuum control housing, illustrated in FIG. 13, the hood valve connection illustrated in FIG. 15C is established. More specifically, in this position the nozzle is connected through the groove 148 with the primary vacuum source 15 and the hood is vented through the groove 146 to the vent 152. This hood and nozzle connection position is established by injecting air through the port 8 and injecting air through the port 6 to drive the piston downwardly as seen in FIG. 13.

Figure 15D:
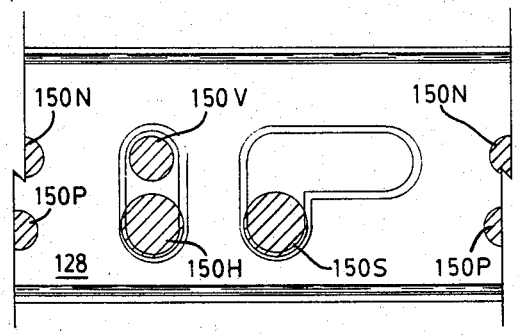

The final hood and nozzle vacuum connection established by the vacuum valve is illustrated in FIG. 15D. In this configuration, pneumatic pressure has been introduced through port 5 to drive the piston 134 in an upwardly direction as seen in FIG. 13, thereby rotating the rotor 128 approximately 90 degrees and connecting the hood to the vent and sealing the nozzle as illustrated. This is the condition established for safety purposes in response to the vacuum level activator diagrammatically illustrated in FIG. 11 at 156 detecting a preselected vacuum condition as may be established upon the bag bursting for example. This vacuum level activator 156 will be described in greater detail hereinafter. More specifically, if the bag were to burst within the hood, this vacuum level activator 156 would cause an automatic introduction of air through the port 5 to shift the nozzle and hood vacuum conditions to the situation illustrated in FIG. 15D.

Figure 11:
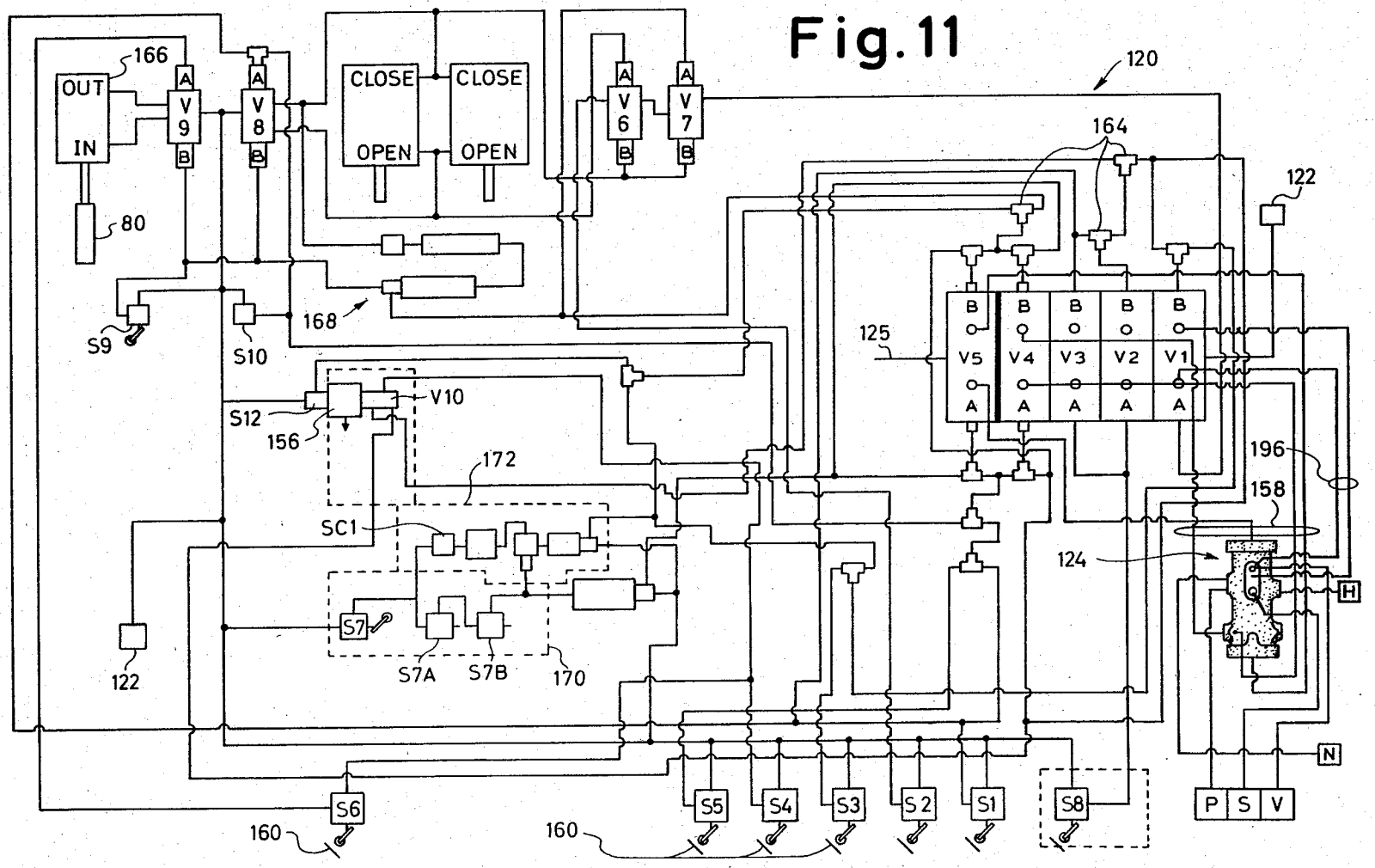
FIG. 11 illustrates a pneumatic schematic of the control system.

Referring now in greater detail to the pneumatic system and the operational sequence of the preferred embodiment, a schematic diagram of the control system is illustrated generally at 120 in FIG. 11. While the embodiment described uses pneumatic switching and valving, it will of course be recognized by those skilled in the art that alternate means of powering and controlling the system can be provided. For example, the operational sequence of the system and the switching of the various pneumatic components could be controlled electronically as with a microprocessor.

The control system generally indicated at 120, controls the mechanical movements associated with the various stations, and each of the stations 18 will be connected in the illustrated embodiment to a control system 120. More specifically, the pneumatic control system 120 is connected to a pneumatic source illustrated diagrammatically at 122. This source is of conventional design and serves to supply pneumatic pressure through the various conduits of the control system 120 to activate the cylinders for raising and lowering the hood, for extending and retracting the platen and for extending and retracting the probe. Also, the pneumatic supply 122 is selectively connected with the vacuum control valve 124 which controls the connection of the nozzle and the hood with the primary, and secondary vacuum sources, respectively, and with a vent to the ambient atmosphere. Moreover, the control system selectively controls various fail safe features which assist in preventing damage to the machine during its operation. More specifically, the switches labeled S1–S10 are mechanically actuated and serve to control various of the valves labeled V1–V10 for selectively supplying or eliminating the supply of pneumatic pressure to the various cylinders and the vacuum control valve 124.

It will be recognized that suitable seals will be provided in the vacuum control valve 124 to seal the rotor and its grooves from the housing. Similarly, seals will be provided proximate the ends of the rotor to affect the longitudinal movement.

The vacuum valve 124 is shifted longitudinally by a pneumatic pressure of approximately 20 p.s.i. in the preferred embodiment to prevent damage to the valve components. In this connection, valve V5 through which the shifting of the control valve 124 is accomplished through the lines 158, connects the reduced pressure supply line 125 to the shifting ports 7 and 8 of the vacuum valve. Thus, the pressure in the supply line 125 is less than the pressure in the lines connected to the source 122 which supplies the various cylinders. Valve V4 which supplies axial shifting to ports 5 and 6 is connected to the source or line pressure 122.

The general operation of the machine will now be described in connection with various mechanical movements and in connection with the pneumatic diagram described in FIG. 11. Generally, switches S1–S8 and S10 are carried proximate the lower arms 28 on each station and are activated by traveling over a tripper illustrated diagrammatically at 160 in FIG. 11. These trippers are mechanically secured to the frame such that upon movement of a particular switch into contact with the tripper, the switch is activated which in turn activates an operatively associated valve for connecting a pneumatic cylinder or the control valve to a supply source such as source 122 to perform a particular mechanical operation.

The shuttle valves 164 are of conventional design and upon receiving a pneumatic pulse, these valves will open the line which is approximately 90 degrees away from the line of the pulse source. They will then vent through the third line connected thereto. Valves V6–V9 are also of conventional design and will open a port on the opposite side of the valve from the line injecting the pneumatic pressure. For example, if pneumatic pressure enters valve V9 through port B, this pressure will be injected into the nozzle drive cylinder 166 through the port labeled "OUT" such that the nozzle 80 is extended. Moreover, as necessary or desired, pressure regulators such as regulator 168 are connected into the various lines to assure the proper pneumatic pressure levels.

The machine operation will now be described by taking an exemplary station through one complete cycle as seen in the plan view of FIG. 1. The desired sequence will be accomplished by rotation of the machine in a clockwise direction. However, as necessary or desired, the machine can be constructed for rotation in a counter-clockwise direction. For reference purposes, the sequence will be commenced at approximately the 1:30 position of FIG. 1. At this point, the hood is in its raised position, the probe 80 has been retracted, the hood is vented and the nozzle vacuum is off. Also, the clamps are in an open position and the platen has been extended as seen in FIG. 2B, to facilitate loading a bagged product. Between approximately the 1:30 and 2:20 positions, the operator places the bagged product on the platen and positions the bag neck about the nozzle 56. Switch S9 is depressed by the operator to close the clamps for hermetically sealing the bag and the nozzle. The pneumatic system illustrated in FIG. 11 enables the operator to select one of two modes of operation. If he holds the switch S9 down or depresses the switch twice, it will shift the vacuum control valve 124 such that it automatically turns on the nozzle vacuum enabling a mode of operation very similar to the operation described in U.S. Pat. No. 3,795,085 incorporated herein by reference and assigned to a common assignee. More specifically, by holding switch S9 down or by depressing such switch twice, the nozzle is connected to the primary vacuum source to commence evacuation of the bag. In this semi-automatic mode of operation the hood is never lowered.

The alternate mode of operation which is activated by a single depression of switch S9 by the operator, commences the automatic mode of operation which will now be described. In the automatic mode of operation, a station rotates to the 2:30 position, and the probe 80 extends into the bag to stand off the product and provide ports for drawing the bag vacuum. The probe 80 is extended in response to operation of the switch S9 which is connected to valve V9 which is signalled to extend the probe 80.

In this position, the hood is vented, the probe is extended, the nozzle vacuum is off, the clamps are closed and the platen is now retracted in response to tripping switch S8. S8 is associated with and connected to the third station in opposition to the direction of rotation.

Upon the station reaching the 3:00 position, switch S2 is tripped and the hood is moved downwardly to create a hermetically sealed chamber between the hood and platen.

Upon movement of a station to approximately the 4:30 position the hood is connected with the secondary vacuum as illustrated in FIG. 15B by the vacuum control valve 124. This vacumm control position is accomplished by the introduction of air through port 6 and port 7 of the vacuum control valve in response to tripping switches S7, S7A, and S7B . In this station positon the chamber exterior the bag is commenced to be evacuated and the bag balloons under the reduced pressure.

Upon the station traveling to approximately 5:00, the hood vacuum reaches a predetermined level and the nozzle is connected to the primary vacuum source to commence the evacuation of the interior portion of the bag. When the vacuum level within the hood and exterior the bag has been established, it is maintained by shifting port 150H such that it is sealed (see FIG. 15C). The hood vacuum is sensed by the vacuum level activator 156, which switches S12 to turn on the nozzle vacuum and maintain the hood vacuum.

As the vacuum level is being established within the bag by connection of the bag interior with the primary vacuum source, the station rotates to the 8:00 position and the hood is raised by tripping the switch S3. Also in response to tripping switch S3, the hood is vented by the positioning of the vacuum control valve in the positon illustrated in FIG. 15C. The primary vacuum is continually applied to the nozzle.

When the system reaches approximately the 9:30 position, switch S4 is tripped to extend the platen to the position shown in FIG. 2B.

As the station rotates to the 11:00 position the bag is evacuated to the preselected condition such as 27 inches Hg. It will be noted that the final vacuum condition of the bag when the machine is in the automatic mode of operation will be a higher level of vacuum or less pressure than the level of vacuum maintained within the hood. This gradient has been found to enhance the capability of evacuating the bag and reduce the development of air pockets between the product and the bag itself.

In the 11:00 position, the platen extends to the position shown in FIG. 2 and the system is preparing for the sealing/trimming operation.

At the 11:45 position the probe is retracted by tripping switch S4 and switch S6. It will be noted that switch S6 acts through switch S4 to accomplish the probe retraction by activation of the appropriate probe cylinder.

As the station approaches the 12:00 position the hood is in the up position, and the nozzle is sealed to the bag by the closed clamps. The sealing/trimming operations are completed by the sealing and trimming device 84 carried by means 86 described hereinabove. The carriage for the device 84 and the device 84 itself are triggered by a switch (not shown) connected to the sealing device which is activated as the station approaches this device 84.

The bag is sealed and trimmed and simultaneously the vacuum application to the nozzle is ceased to prevent ambient pressure from entering the primary vacuum system. This operation is controlled by the sealing/trimming device activating a conventional pneumatic tripper to switch S5.

At approximately the 12:30 position the platen is extended and sloped to the position illustrated in FIG. 2C by activation of swtich S1. With the platen in the sloped position, the bagged product is unloaded as onto a conveyer belt for further processing.

At the 1:00 position the bag trimming or tail is removed manually by the operator or with a suitable vacuum source. Thus, the platen is in the position illustrated in FIG. 2B. The operator then places another bagged product on the platen between the 1:30 and 2:20 position and the cycle is continued.

Figure 14A:
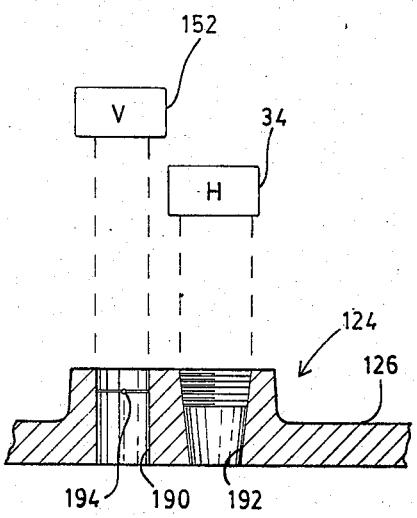
FIG. 14A shows a cross-sectional view of the hood and vent ports of the vacuum control valve.
Figure 14:
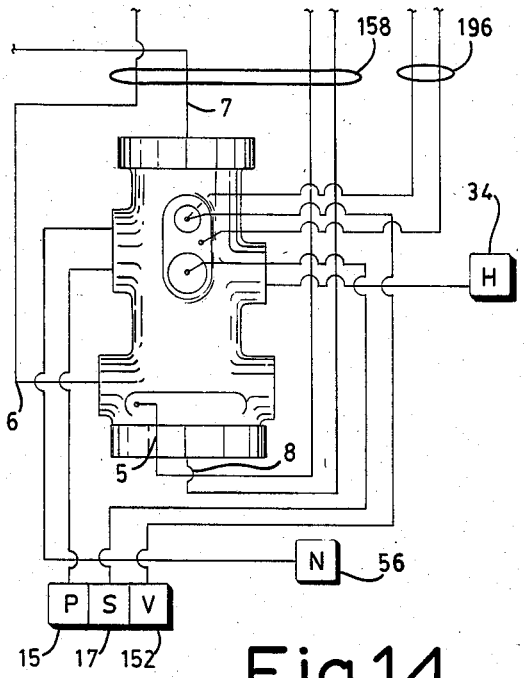
FIG. 14 shows a pnuematic schematic of the vacuum control valve portion of the control system.

The hood and vent ports 190 and 192, respectively of the vacuum control valve 124, are shown in FIG. 14A. It is desired to close the vent port when the valve 124 is in the position shown in FIG. 15C in order to prevent the ambient atmosphere from being drawn into the vacuum system through the nozzle. This can be accomplished by positioning a conventional butterfly valve 194 in the vent port of the vacuum control valve 124, as shown in FIG. 14A. This valve is connected as shown in FIG. 11, for purposes of activation thereof when it is desired to seal the vented nozzle. More specifically, lines 196 (see FIGS. 11 and 14) serve to selectively connect the supply 122 to a conventional valve activator for operation of this valve. Thus, the vacuum control valve 124, with the valve 194 added thereto is a four position (see FIGS. 15A–D) five function valve.

In the event the operator selects the alternate mode of operation by maintaining switch S9 in a depressed position or by activating this switch with two strokes, the above automatic mode of operation will be followed with the exception that the hood will not be lowered and the hood vacuum will not be activated.

Various safety features are incorporated into the machine 10 in order to assist in preventing aberrant operation. For example, switches 7 and 7A–B illustrated in FIG. 11 are connected in series such that they must be depressed before the hood vacuum will commence. These switches, S7 and S7A–B, etc. are carried at spaced locations along the edge 38 of the hood as shown in FIG. 2B such that the hood must be seated before the hood vacuum can commence. It will be noted that each of the alphabetically indicated switches S7A, B, etc., must be simultaneously depressed in order to enable the hood vacuum.

As described above, the vacuum level activator 156 and the S12 serve to shift the vacuum to the nozzle and position the hood vacuum in an off mode as indicated in FIG. 15C, in the event the pressure within the hood reaches a preselected level such as 20 inches Hg. Moreover, the vacuum level activator also allows switch S4, through valve V10, to extend the platen if the hood is vented. If the hood is not vented switch S4 moves the vacuum valve to the position indicated in FIG. 15D which vents the hood and shuts off all vacuum connections. Thus, switch S4 extends the platen and opens the hood as a failsafe if the other switching fails at approximately the 10:30 position to prevent the hood from contacting the sealing/trimming device or other machine parts.

Thus, if the hood is still under vacuum at the 10:00 position, this vacuum is sensed by the vacuum level activator and the hood is vented and raised while the platen is extended as described above.

If all hoods are still down upon a station reaching the 11:00 position, an additional failsafe device detects such condition and will automatically shut down the machines rotation.

Switch S1 serves as a backup pulse to ensure that the platen is in the sloped position and to assure that the vacuum control valve 124 is in the position shown in FIG. 15A. It further opens the clamps through valve V8.

When switch S9 is activated, the valve V9 is signalled to extend the probe. Simultaneously, a signal is given through valve V8 to close the clamps. Also pressure is exerted on switch S11 after the clamps are closed, and air is directed through SC1 which is a delay mechanism. If constant pressure or a double pulse is applied to switch S9 the delay mechanism opens switch S11 which moves the vacuum valve to the FIG. 15C position which is the hood "OFF" and nozzle "ON" condition. Further, valve V6 is moved to a vent position which prevents the hood from closing. This prevents use of the hood if vacuum has previously been applied. This would occur if the operator determines the product is too large or a load is improper, thus he can hit switch S9 again which would prevent the hood from closing.

In the event a bag bursts, the nozzle vacuum is opened into the hood. In that event, valve V10, which is a four-way valve and energized by the position of the valve V10 which is mounted on the vacuum limit activator 156 will vent the hood totally by shifting the vacuum control valve 124 to position shown in FIG. 15D. This prevents any vacuum from being applied to that station whatsoever.

Circuits 170 and 172 are pneumatic circuits controlled and actuated by operation of the hood. When a pulse is received for the hood to come down, switch S7 is actuated when the hood is nearly seated. Switch 7A and switch 7B are tied in series to switch S7 such that if either switch 7A or 7B does not close, the delay circuitry in circuit 172 is actuated to turn the vacuum onto the nozzle and raise the hood automatically. Switch S7, switch 7A and switch 7B are mounted at various locations along the rim of the hood to sense a condition which would prevent the hood from obtaining a full seat. In the event that condition is sensed, the station shifts to the hood up position and the semi-automatic mode of operation is commenced, which would be the FIG. 15B position of the vacuum valve. In this mode of operation, the hood remains up and vacuum is applied only to the interior of the bag through the nozzle.

Figure 16:
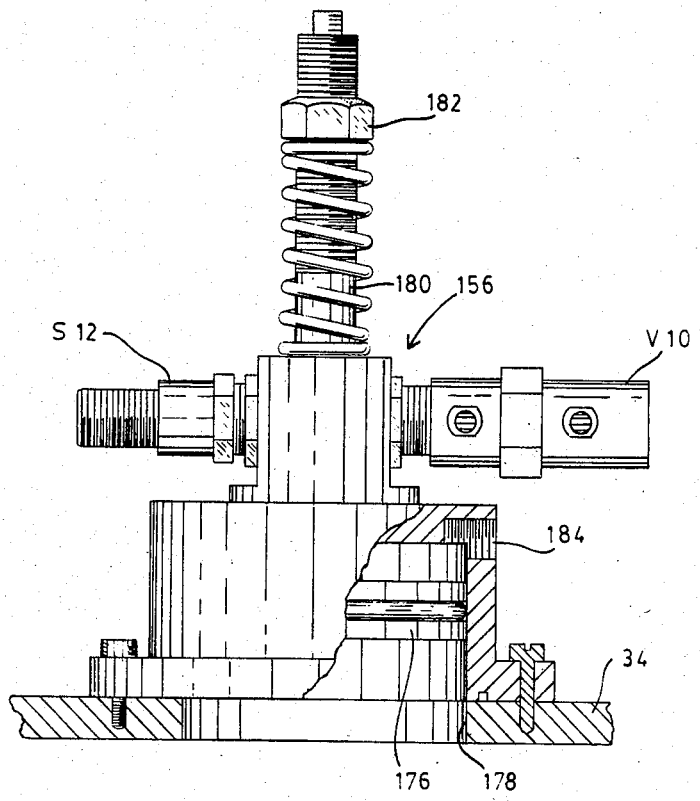
FIG. 16 is an elevation view of a vacuum activator with a portion of the housing broken away for purposes of illustration.

A suitable vacuum level activator 156 is illustrated in FIG. 16. This vacuum level activator is preferrably mounted on the upper portion of a hood 34 proximate the location 174 as indicated in FIG. 6. More specifically, the vacuum activator 156 is piston operated, and includes a piston 176 which is slideably mounted within the illustrated cylinder which opens through port 178 into the hood chamber. This piston 176 includes a piston rod 180 which is spring biased in an upwardly direction as indicated in FIG. 16. Preferrably, a shoulder washer is mounted such that it receives the upper most end portion of the illustrated spring to assure proper positioning of the spring and to prevent the piston rod from tilting during movement. It will also be recognized that the force required to draw the piston 176 downwardly in response to a vacuum within the hood can be adjusted by threadably advancing the spring nut 182. In the event vacuum is applied to the hood, the piston is drawn downwardly by atmospheric pressure acting on the backside of the piston through port 184 to the ambient atmosphere. The piston rod is then drawn down which actuates switch S12 and the valve V10 which are connected into the pneumatic control circuit as illustrated in FIG. 11. The rod 180 which is spring biased can be adjusted to trigger switch S12 and valve V10 at preselected vacuum levels.

From the foregoing detailed description, it will be recognized that an improved high speed evacuation chamber packaging machine has been provided. The machine of the present invention is designed such that separate and controllable vacuum sources balloon the bag prior to evacuation of the bag interior to a preselected level. In this manner, the likelihood of the development of air pockets within the bag proximate the product is reduced and accordingly the shelf life of the bagged product is increased. The separation of the vacuum sources, viz. the primary vacuum and secondary vacuums, prevents any manifold effect. Additionally, the system is designed such that there is a constant drawn down with a controlled differential pressure inside and outside the bag to enhance the avoidance of the development of air pockets. The machine can be used in the automatic mode of operation or, if desired, in a manner such that the vacuum exterior the bag is not generated. Thus, the machine can be operated even if the product is larger than the hood such that the hood forms a seal with the platens.

While a preferred embodiment has been described and illustrated, it will be recognized by those skilled in the art that certain modifications can be made in the invention without departing from invention spirit. For example, while the device of the present invention has been described and illustrated in connection with the rotating configuration, it will be recognized that the system could be mounted on a conveyer. The number of stations is insignificant and may be as few as one. Moreover, while a pneumatic system has been described and illustrated for affecting the mechanical motion it will be recognized that various other devices can be used both for connecting the hood/nozzle with a suitable vacuum source and vent and for performing the various mechanical motions employed by the system. For these reasons among others, the invention should be limited only by the appended claims and the equivalents thereof.

We claim:

1. A high speed evacuation chamber packaging machine for the high speed evacuation and positive sealing of flexible receptacles or bags containing a product, said bag defining one open end portion proximate the bag neck for receiving the product, said evacuation being accomplished by evacuating the volume within said bag and exterior said bag to preselected levels, said bag and product contained therein, hereinafter being referred to at time as a bagged product, said machine comprising:

a frame, said frame comprises an upright hub and a wheel member rotatably mounted on said hub, said wheel member being provided with a plurality of selectively spaced radially extending arms and drive means for rotating said wheel member about said hub;

a plurality of stations carried by said frame, each said station including a platen facing upwardly for carrying the bagged product during the evacuation operation, a hood associated with said platen and selectively operable between an open position for loading and unloading said bagged product and a closed position defining an evacuation chamber with said platen, means for selectively evacuating and repressurizing said chamber containing said bagged product in the volume exterior said bagged product to preselected levels, means for selectively evacuating said bag to a preselected vacuum level, said means for selectively evacuating said bag to a preselected vacuum level including a further vacuum source and a nozzle for selectively connecting said further vacuum source in fluid communication with the internal portion of said bag and valve means for selectively connecting said further vacuum source with said internal portion of said bag, said nozzle defining a rear end portion connected in fluid communication with said further vacuum source and a forward end portion for being received in said neck portion of said bag and wherein said means for maintaining the evacuated status of said bag comprises a pair of oppositely disposed cooperating clamp members for selectively gathering and sealing said neck portion of said bag about said forward end portion of said nozzle, whereby said evacuated status of said bag is maintained subsequent to the evacuation of said bag to said preselected level and subsequent to the movement of said hood to said open position thereby facilitating the efficient sealing of said bag with said means for positively sealing said bag, said nozzle further includes a nozzle probe operable between extended and retracted positions for facilitating the application of said vacuum source to the internal portion of said bag containing said product, said nozzle probe being provided with at least one groove defining a path of travel for establishing fluid communication between said vacuum source and said internal portion of said bag, whereby said nozzle probe is selectively extended so as to locate said product contained within said bag remote from said forward end portion of said nozzle;

means for positively sealing said bag subsequent to evacuation thereof, said means for sealing said bag subsequent to evacuation thereof comprising closure means mounted proximate said frame for closing and sealing the open end portion of said bag to seal said bag from the ambieint atmosphere;

means for trimming said bag subsequent to said sealing operating; and carriage means for carrying said closure and trimming means, means for mounting said carriage means for pivotal movement about an axis outside said wheel, means for moving said carriage means to move said closure and trimming means from a first position to a second position along an arc substantially identical to the arc of travel of said neck of said bag carried by said operatively associated station whereby said closure and trimming means and said neck of said bag travel along a substantially identical path from said first position to said second position during the closure and trimming operation, said closure and trimming operation being completed upon said closure and trimming means reaching said second position, and whereby said closure and trimming means are retracted to said first position to allow repetition of said closure and trimming operation with respect to said bags carried by other said stations.

2. The machine of claim 1 wherein each said cooperating clamp member defines an indented section, and wherein said nozzle is provided with an annular groove receptive of said indented sections of said clamp members whereby the sealing of said neck portion of said bag about said nozzle is facilitated.

3. The machine of claim 1 including means operatively associated with each said platen for retracting and extending said platens and sloping said platens with respect to the horizontal at a preselected angle, to facilitate the loading and unloading of said bag and bagged product, said means comprising at least a pair of guide rollers operatively associated with each side of each said platen, and a pair of guides mounted on said radially extending arms operatively associated with each said pair of guide rollers, each said pair of guides defining a preselected path, whereby each said pair of guide rollers is received in one said pair of guides such that said platen is movable with respect to said radial arms thereby facilitating the retracting, extending, and sloping of said platen.

4. The machine of claim 1 including means for moving said hood between said open position for loading and unloading said bagged product and said closed position for defining an evacuation chamber with said platen.

5. The machine of claim 4 wherein said hood is pivotally mounted on said frame and wherein said means for moving said hood comprises a pneumatic cylinder operatively associated with said hood for pivoting said hood with respect to said platen.

6. The machine of claim 3 wherein said hood is pivotably mounted on said wheel and wherein said means for moving said hood comprises a pneumatic cylinder operatively associated with said hood for pivoting said hood with respect to said platen.

* * * * *